US007885573B2

(12) United States Patent
Tomoe

(10) Patent No.: US 7,885,573 B2
(45) Date of Patent: Feb. 8, 2011

(54) CLEANING DEVICE, AND IMAGE FORMING APPARATUS PROVIDED WITH THE SAME

(75) Inventor: Tetsuro Tomoe, Osaka (JP)

(73) Assignee: Kyocera Mita Corporation (JP)

( * ) Notice: Subject to any disclaimer, the term of this patent is extended or adjusted under 35 U.S.C. 154(b) by 241 days.

(21) Appl. No.: 12/197,339

(22) Filed: Aug. 25, 2008

(65) Prior Publication Data

US 2009/0052929 A1 Feb. 26, 2009

(30) Foreign Application Priority Data

Aug. 24, 2007 (JP) ..... 2007-217899

(51) Int. Cl.
*G03G 15/16* (2006.01)

(52) U.S. Cl. ..... 399/101

(58) Field of Classification Search ..... 399/71, 399/101, 343, 345, 353, 357, 350
See application file for complete search history.

(56) References Cited

U.S. PATENT DOCUMENTS 4,174,172 A * 11/1979 Lane ..... 399/345
4,449,241 A * 5/1984 Nakayama
2007/0231012 A1* 10/2007 Yokota et al.

FOREIGN PATENT DOCUMENTS

JP 61005272 A * 1/1986
JP 2000181314 A * 6/2000
JP 2002-132059 5/2002
JP 2006-184885 7/2006

* cited by examiner

*Primary Examiner*—Susan S Lee
(74) *Attorney, Agent, or Firm*—Gerald E. Hespos; Michael J. Porco

(57) ABSTRACT

A cleaning device for cleaning an image forming surface of a rotating image bearing member that bears a toner image includes a cleaning member that faces and cleans the image forming surface. An operating mechanism allows the cleaning member to come in press-contact with and separate from the image forming surface. A controller controls the operating mechanism. The image bearing member rotates so that in a state where a toner image is on the image forming surface, the toner image passes through a facing position at which the cleaning member faces the image forming surface, and the controller controls the operating mechanism so that the cleaning member comes in press-contact with the image forming surface during an interval period between passing of the toner image through the facing position and arriving of the toner image at the facing position again.

15 Claims, 10 Drawing Sheets

CLEANING DEVICE, AND IMAGE FORMING APPARATUS PROVIDED WITH THE SAME

BACKGROUND OF THE INVENTION

1. Field of the Invention

The present invention relates to cleaning devices provided in image forming apparatuses such as copying machines, printers, and facsimile machines, and image forming apparatuses provided with the same.

2. Description of the Related Art

Generally, an image forming apparatus is provided with an image bearing member, and a toner image formed on an image forming surface of the image bearing member is transferred to a sheet at a transfer nip portion. There has been a known cleaning device which performs a cleaning processing of removing toners remaining on the image forming surface after the transfer processing is performed (for example, Japanese Patent Unexamined Publication No. 2002-132059, Japanese Patent Unexamined Publication No. 2006-184885).

In this device, a cleaning brush is so provided as to be capable of coming in contact with or separating apart from an image forming surface. After a toner image is transferred to a sheet, the cleaning brush comes in contact with the image forming surface, so that the image forming surface is cleaned.

According to the above-described conventional technology, the image forming surface is cleaned only after the toner image is transferred to the sheet. Accordingly, frequency in cleaning the image forming surface is small, so that it causes a problem that favorable image quality cannot be maintained.

SUMMARY OF THE INVENTION

An object of the present invention is to provide a cleaning device which maintains favorable image quality, and an image forming apparatus provided with the same.

A cleaning device in accordance with an aspect of the present invention which achieves this object includes a cleaning device for cleaning an image forming surface of a rotating image bearing member which bears a toner image, and the cleaning device includes: a cleaning member which faces the image forming surface at a predetermined position to clean the image forming surface; an operating mechanism for allowing the cleaning member to come in press-contact with and separate apart from the image forming surface; and a controller for controlling the operating mechanism. The image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

A cleaning device in accordance with another aspect of the present invention has a configuration which is the same as the one described above, and the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

Further, according to an image forming apparatus in accordance with yet another aspect of the present invention includes: a rotating image bearing member including an image forming surface on which a toner image is formed; and a cleaning device for cleaning the image forming surface, and the cleaning device has a configuration described above.

These and other objects, features and advantages of the present invention will become more apparent upon reading of the following detailed description along with the accompanied drawings.

DETAILED DESCRIPTION OF THE PREFERRED EMBODIMENTS

Figure 1:
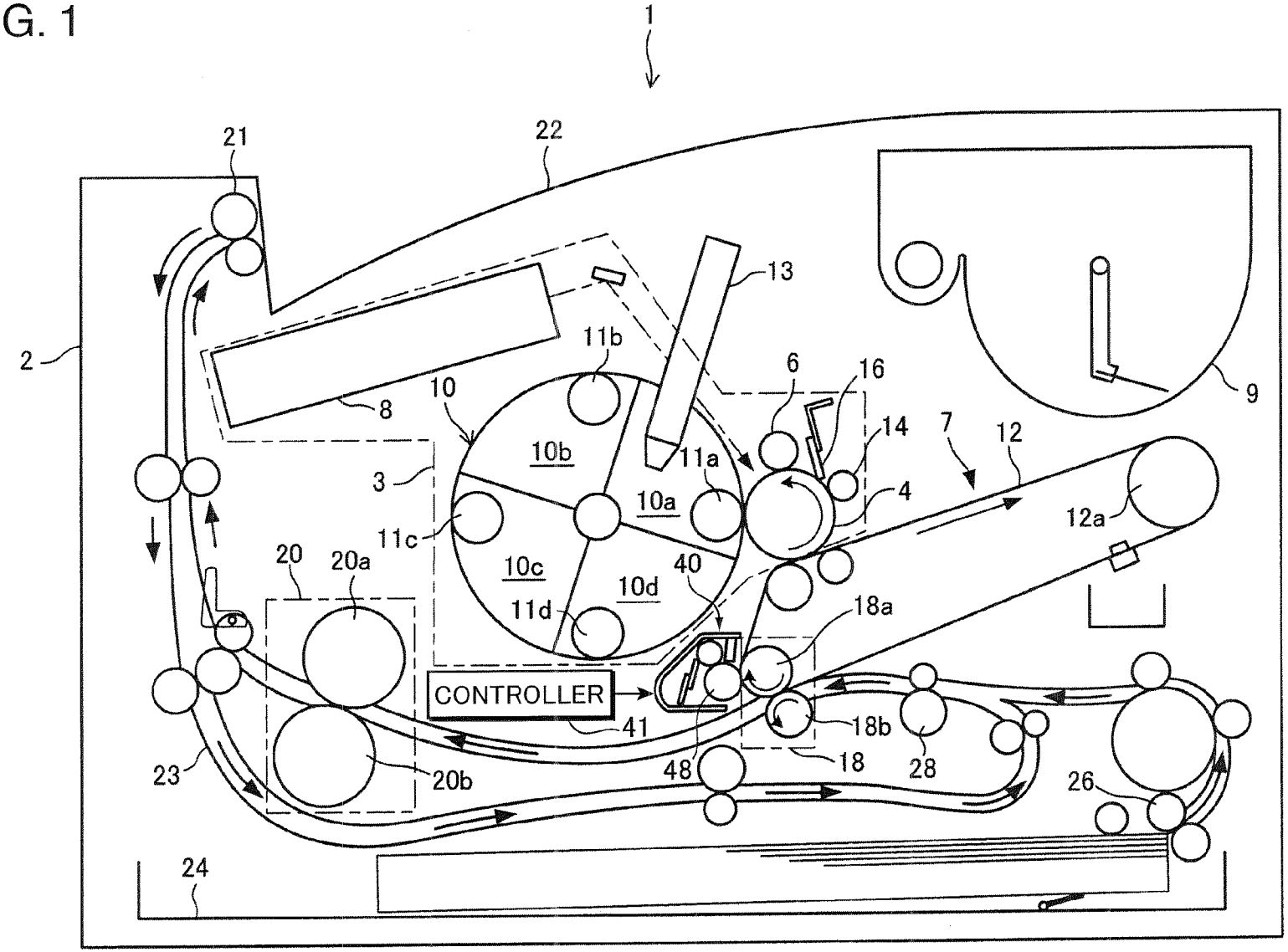
FIG. 1 shows a schematic configuration of a printer in accordance with an embodiment of the present invention.

FIG. 1 shows a schematic configuration of a printer 1 (image forming apparatus) in accordance with an embodiment of the present invention. A right side in the drawing corresponds to a front side of the printer 1, and a left side corresponds to a back side.

In an apparatus main body 2 of the printer 1, there is provided an image forming section 3 having a photoconductive drum 4. On an outer peripheral surface of the photoconductive drum 4, a layer of a photoconductive member made of, for example, amorphous silicon is formed. The photoconductive drum 4 is rotated in a counter-clockwise direction in FIG. 1, and a series of operations including forming of an electrostatic latent image, developing of an electrostatic latent image by toners, and primary transferring of a toner image is performed on the outer peripheral surface.

In particular, in periphery of the photoconductive drum 4, there is provided a charging device 6 which comes close to an upper position of the photoconductive drum 4. The charging device 6 charges the outer peripheral surface of the photoconductive drum 4. In a state where the photoconductive drum 4 is charged, a scanning light is irradiated from a laser scanning unit 8 to the outer peripheral surface.

The unit 8 rotates, for example, a polygon mirror at a high speed to reflect the laser light, and the laser light scanning in a rotational axis direction of the photoconductive drum 4 is reflected by a flat mirror, so that the outer peripheral surface of the photoconductive drum 4 is subjected to an exposure. Accordingly, an electrostatic latent image is formed on the outer peripheral surface of the photoconductive drum 4.

Further, in a rotational direction of the photoconductive drum 4, there is disposed a developing unit 10 on a downstream of a position to which the scanning light is irradiated. The developing unit 10 is so provided as to come close to the outer peripheral surface of the drum 4, and the electrostatic latent image is developed with toners of four colors (for example, magenta, cyan, yellow, and black) in a rotary method. In other words, the developing unit 10 is so configured as to be also rotatable, and has four developing equipments 10*a*, 10*b*, 10*c*, and 10*d* partitioned for respective colors along its rotational direction.

The developing equipments 10*a*-10*d* contain toners and are provided with developing rollers 11*a*-11*d* which rotate while bearing toners on their respective outer peripheral surfaces. Further, at an appropriate position near the front side of the printer 1, there is provided a toner container 9. Toners of respective colors are supplied to the developing equipments 10*a*-10*d* through a feed pipe 13.

Rotation of the developing unit 10 causes some of the developing equipments 10*a*-10*d* corresponding to colors which should be developed to approach and stop to face the outer peripheral surface of the photoconductive drum 4. On the other hand, in the developing equipments 10*a*-10*d*, the developing rollers 11*a*-11*d* rotate while bearing toner thin layers on their respective outer peripheral surfaces, and a developing bias voltage including an AC component and a DC component is applied to the rollers 11*a*-11*d*. Accordingly, the toners bore on the rollers 11*a*-11*d* are transferred to the electrostatic latent images on the drum 4, so that the electrostatic latent images are developed by toners of respective colors.

In periphery of the photoconductive drum 4, there are provided a rubbing member 14 and a cleaning member 16 along the outer peripheral surface. The rubbing member 14 and the cleaning member 16 are provided on an upstream in the rotational direction of the photoconductive drum 4. After the toner image is primarily transferred, the rubbing member 14 polishes the outer peripheral surface of the drum 4, and then removes oxidized products adhered to the photoconductive member layer. On the other hand, the cleaning member 16 removes toners remaining on the outer peripheral surface of the photoconductive drum 4 to clean the outer peripheral surface before the next image forming is performed.

Beneath the photoconductive drum 4 and the toner container 9, there is provided an intermediate transferring unit 7. The intermediate transferring unit 7 includes an endless intermediate transferring belt 12 (image bearing member), and its surface (image forming surface) is disposed so as to come close to the outer peripheral surface of the drum 4. The intermediate transferring belt 12 includes, for example, a belt formed by a sheet member made of dielectric resin and whose opposite end portions are layered to be connected, or a (seamless) belt having no seam.

The intermediate transferring belt 12 is wound around a driving roller 18*a* and a tension roller 12*a*, and a primary transfer position with respect to the drum 4 is provided between the rollers. Specifically, the driving roller 18*a* is disposed on upstream of the primary transfer position in a rotational direction of the intermediate transferring belt 12, and the tension roller 12*a* is disposed on downstream. An appropriate amount of tension toward the intermediate transferring belt 12 is applied to the tension roller 12*a* by a repelling force of, for example, a spring which is not illustrated.

The intermediate transferring belt 12 comes in contact with the outer peripheral surface of the photoconductive drum 4 at a transfer position and runs (rotates) in a circumferential direction in synchronization with rotation of the photoconductive drum 4. The toner image formed on the photoconductive drum 4 is primarily transferred from the outer peripheral surface to the surface of the intermediate transferring belt 12.

A secondary transferring section 18 is configured by the driving roller 18*a* and a transferring roller 18*b* (transferring member). The transferring roller 18*b* rotates in pair with the roller 18*a* while sandwiching the intermediate transferring belt 12, and a transfer nip portion is formed between the intermediate transferring belt 12 and the transferring roller 18*b*.

In FIG. 1, a sheet (sheet-like recording medium) conveying direction is indicated by an arrow. In a lower portion of the apparatus main body 2, a sheet-supplying cassette 24 is disposed, and sheets are stacked and accommodated in the cassette 24. On a downstream side of the cassette 24 in the sheet conveying direction, there are disposed a sheet-feeding roller 26, a registration roller 28, the transferring section 18, and a fixing section 20 sequentially. If a sheet passes through the transferring section 18, a full-color toner image for one page is secondarily transferred from the intermediate transferring belt 12 to the sheet.

The fixing section 20 includes a heating roller 20*a* and a pressing roller 20*b*, and a fixing nip portion is defined by a pressed-contact portion between the rollers 20*a* and 20*b*. The sheet onto which the toner image is transferred is conveyed to the fixing nip portion and then heated and pressed, so that the toner image is fixed to the sheet.

In a case where an image is formed only on one side of the sheet, the sheet which has passed through the fixing section 20 is discharged to the sheet-discharging tray 22 through the sheet-discharging roller 21. On the other hand, in a case where images are formed on both sides of the sheet, the sheet which has passed through the fixing section 20 is pulled back to a sheet-reversing passage 23 through the reversely rotated sheet-discharging roller 21. One end of the passage 23 is connected between the sheet-feeding roller 26 and the registration roller 28, and the sheet in the passage 23 is conveyed again toward the transferring section 18.

Near the secondary transferring section 18 in accordance with the present embodiment, there is disposed a cleaning unit (cleaning device) 40. The cleaning unit 40 is provided so as to face the driving roller 18*a* of the intermediate transferring unit 7. After the toner image on the intermediate transferring belt 12 is secondarily transferred to the sheet, the cleaning unit 40 removes remaining toners adhered to the intermediate transferring belt 12.

Figure 2:
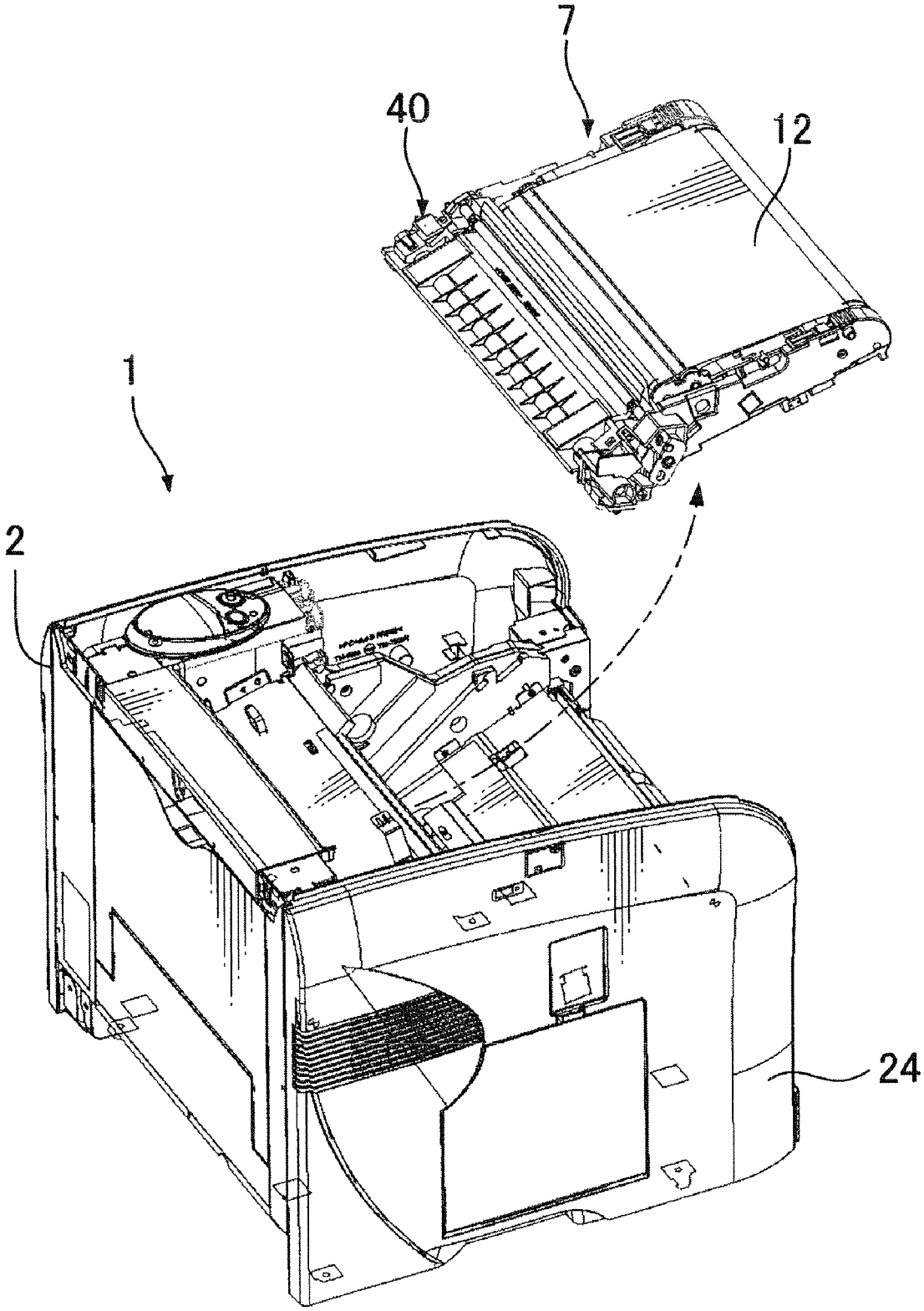
FIG. 2 is a perspective view showing a state where an intermediate transferring unit and a cleaning unit are dismounted from the printer shown in FIG. 1.

FIG. 2 is a perspective view showing a state where the intermediate transferring unit 7 and the cleaning unit 40 are dismounted from the apparatus main body 2. In FIG. 2, an exterior cover and the like of the apparatus main body 2 are omitted from the drawing. If the exterior cover is opened, and the toner container 9 is dismounted, the intermediate transferring unit 7 is exposed to outside. In this state, if a user grabs, for example, an unillustrated handle portion and pulls out the intermediate transferring unit 7 toward an oblique upper right direction, the cleaning unit 40 is also dismounted together with the intermediate transferring unit 7 from the apparatus main body 2.

Figure 3:
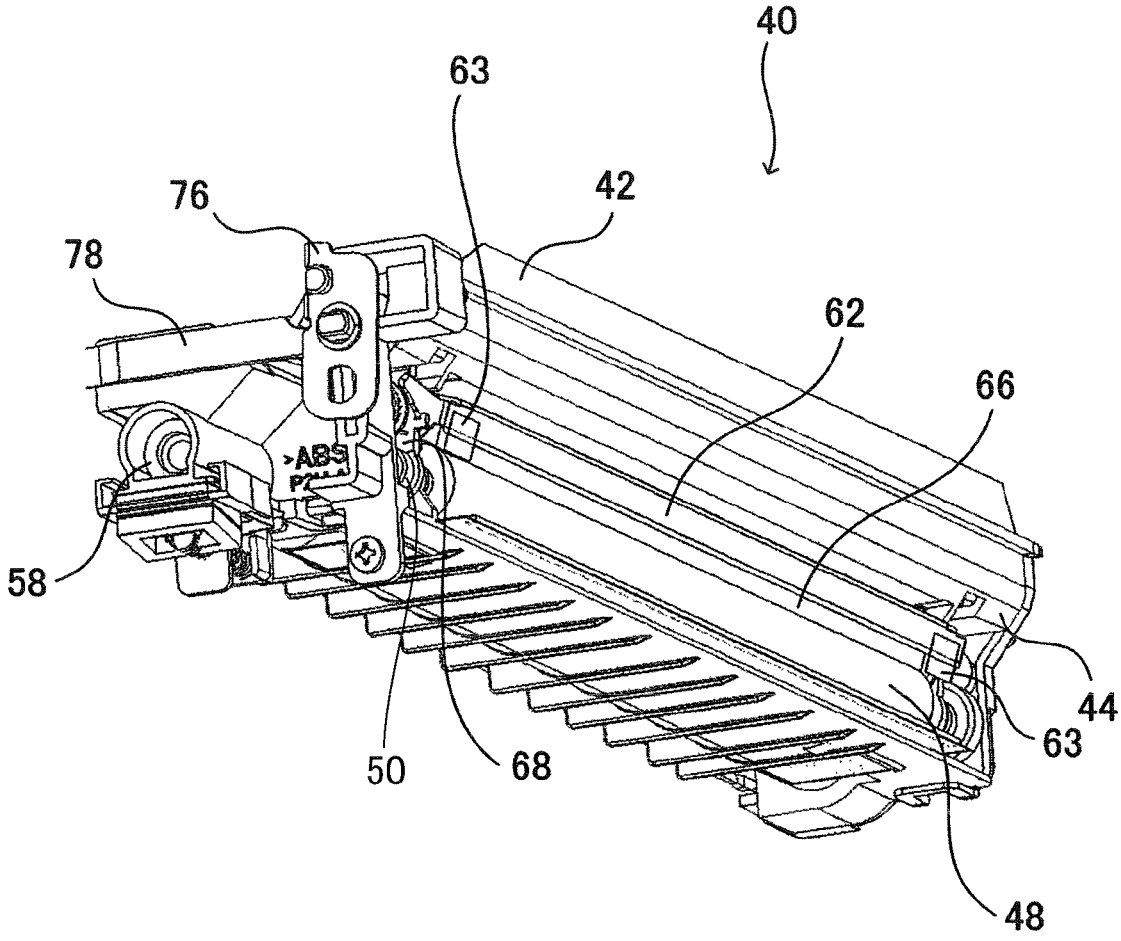
FIG. 3 is a perspective view of the cleaning unit.
Figure 4:
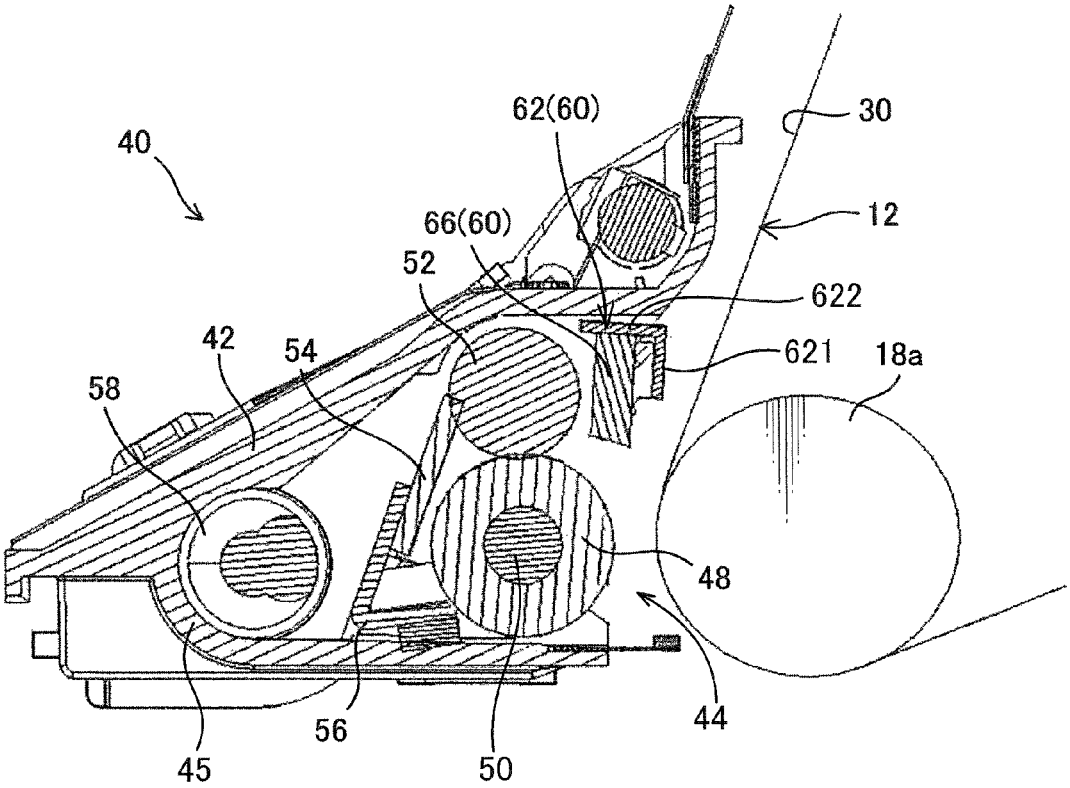
FIG. 4 is a sectional view of the cleaning unit shown in FIG. 3.

FIG. 3 is a perspective view of the cleaning unit. FIG. 4 is a sectional view of the cleaning unit shown in FIG. 3. In the cleaning unit 40, there is provided a roller-like fur brush 48 (cleaning member; roller-like brush member) is provided. The fur brush 48 has a rotational shaft 50 extending in a widthwise direction perpendicular to a rotational direction of the intermediate transferring belt 12, and is rotated about an axis of the rotational shaft 50. The fur brush 48 is disposed at a position of opposing to the driving roller 18*a* and rotates in contact with the intermediate transferring belt 12, so as to electrically remove the toners, which remain after the secondary transfer, from the image forming surface of the intermediate transferring belt 12. As will be described hereinafter, in the present embodiment, there are provided a brush operating mechanism 70 (operating mechanism; refer to FIG. 5) for allowing the fur brush 48 to come in contact with or separate apart from the intermediate transferring belt 12, and a controller 41 for controlling the operation of the brush operating mechanism 70 (refer to FIGS. 1 and 5).

As shown in FIG. 4, the cleaning unit 40 has a housing 42. The housing 42 has an opening 44 which is open toward the intermediate transferring belt 12. The opening 44 faces an image forming surface 30 which is a surface of the intermediate transferring belt 12. Further, the vertical size of the housing 42 is set to become gradually smaller from the opening 44 to a bottom portion 45, and a collecting spiral 58 is disposed near the bottom portion 45.

The fur brush 48 is provided at a position close to the opening 44, and its rotational shaft 50 is provided so as to be substantially parallel to the axis line of the driving roller 18*a*. Opposite ends of the rotational shaft 50 are supported freely rotatably by a plate 68 positioned near side surfaces of the housing 42 (FIGS. 3 and 5).

In the housing 42, there is provided a sweeping roller 52. The sweeping roller 52 is disposed above the fur brush 48 and is substantially parallel to the axis line of the fur brush 48. Opposite ends of the rotational shaft 53 of the sweeping roller 52 are also supported freely rotatably by the plate 68.

To the fur brush 48 and the sweeping roller 52, a voltage can be applied from an unillustrated power source. In a state where a voltage is applied to the rollers, the sweeping roller 52 comes in frictional contact with the fur brush 48 to electrically pick up remaining toners adhered to the fur brush 48.

Figure 5:
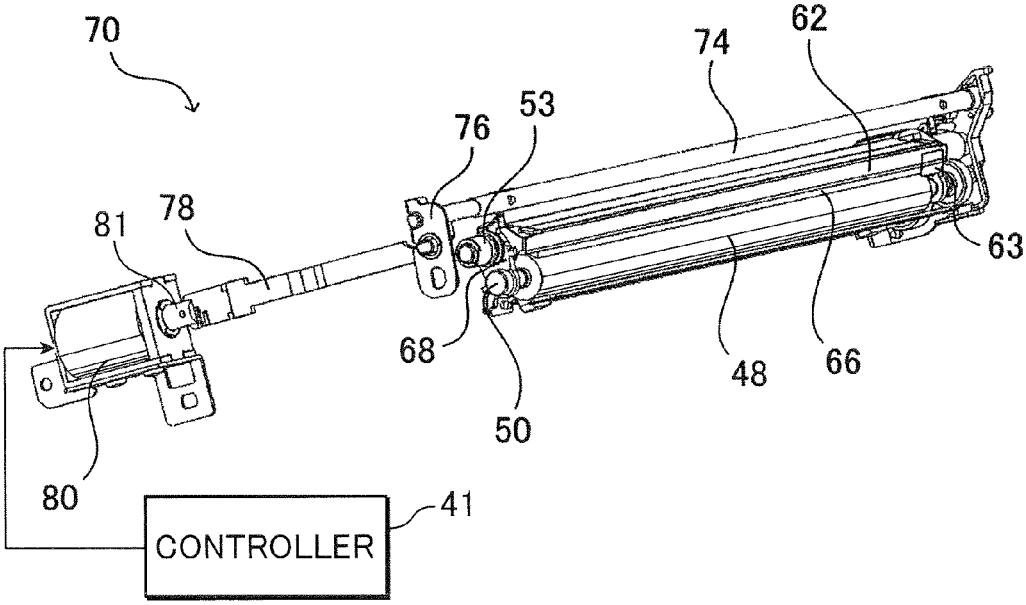
FIG. 5 is a perspective view showing relevant parts of the cleaning unit.
Figure 6:
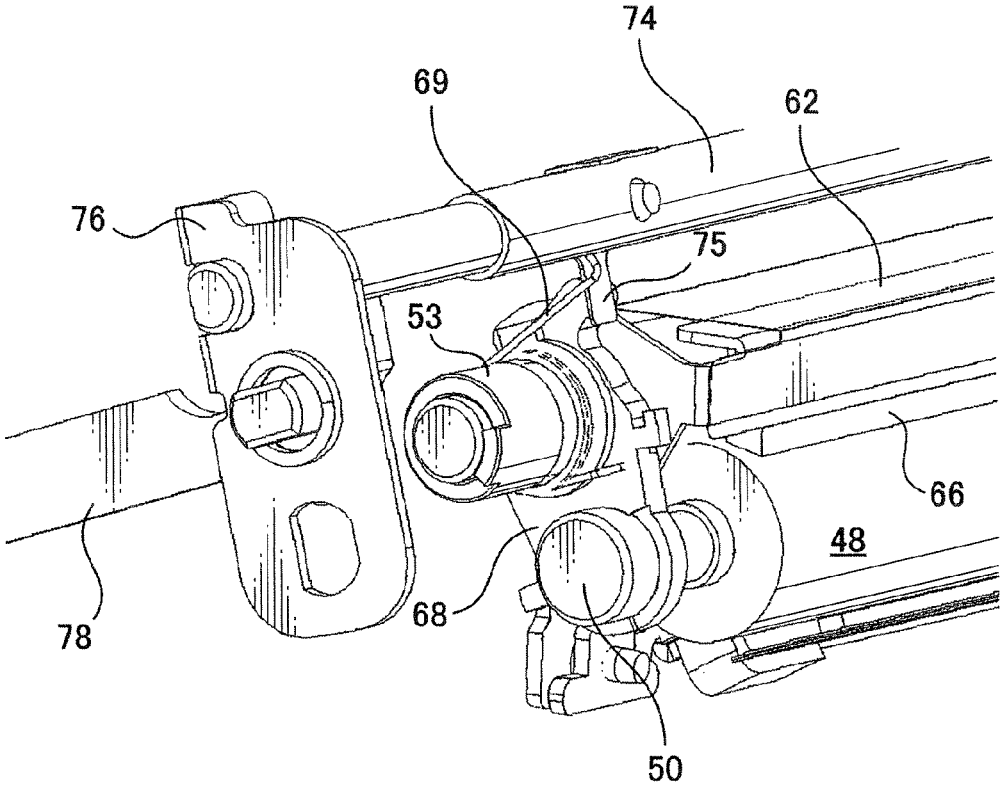
FIG. 6 is an enlarged view of FIG. 5 and shows a separating operation.

FIG. 6 is an enlarged view of FIG. 5. The rotational shaft 53 of the sweeping roller 52 and the rotational shaft 50 of the fur brush 48 are engaged by a torsion spring 69. The torsion spring 69 urges the fur brush 48 toward a direction of separating apart from the image forming surface 30.

Referring back to FIG. 4 again, a supporter 56 is disposed between the fur brush 48 and the collecting spiral 58, and the supporter 56 is provided with a blade 54. The blade 54 is disposed so as to be capable of coming in contact with the sweeping roller 52 to scrape off the remaining toners which are in contact with and adhered to the outer peripheral surface of the sweeping roller 52. The toners which are scraped off are conveyed by the collecting spiral 58 to be collected into an unillustrated waste toner container.

In the housing 42, there is provided a brush bar assembly 60. The assembly 60 is disposed above the fur brush 48 on a side of the sweeping roller 52 closer to the opening 44. The assembly 60 includes a solid lubricant member 66, and a retaining stay 62 for retaining an upper end of the solid lubricant member 66.

The solid lubricant member 66 is an elongated rectangular member provided so as to be substantially parallel to the axis line of the fur brush 48. For example, the solid lubricant member 66 may be a member including a zinc stearate. The solid lubricant member 66 is a member which is so configured as to be capable of coming in contact with the fur brush 48. A lubricating component adhered to the fur brush 48 is given to the intermediate transferring belt 12, so that lubricity is given to the image forming surface 30.

The stay 62 has a substantially L-shaped cross section and includes a front surface 621 so disposed as to face the image forming surface 30 at the opening 44, and an upper surface 622 which is so formed as to be perpendicular to an upper end portion of the front surface 621 and extend toward an inner side of the housing 42. The upper surface 622 retains an upper end of the solid lubricant member 66.

At opposite end portions of the solid lubricant member 66 (opposite end portions in a widthwise direction perpendicular to the widthwise direction of the intermediate transferring belt 12), translucent elastic sheets (closing member) 63, 63 are applied on a front side of the retaining stay 62 (FIG. 3). Each sheet 63 so formed as to be rectangular has an upper half portion applied to the front surface 621 of the retaining stay 62 and a lower half portion extending toward the fur brush 48 to face opposite end portions of the fur brush 48. An axial length of the solid lubricant member 66 is set to be shorter than that of the fur brush 48, and the solid lubricant member 66 and the fur brush 48 are disposed so that respective widthwise center substantially coincide with each other. The difference in lengths defines at opposite end portions of the fur brush 48 non-contact portions at which the fur brush 48 is substantially in noncontact with the solid lubricant member 66. Each sheet 63 has a widthwise length which is substantially the same as a widthwise length of the noncontact portion.

The opposite ends of the stay 62 are supported by the rotational shaft 53 of the sweeping roller 52 freely rotatably on an inner side of the plate 68 (FIGS. 5 and 6). Accordingly, the stay 62 and the solid lubricant member 66 slants downward and toward the brush 48 due to weights of the stay 62 and the solid lubricant member 66 and comes in contact with the fur brush 48 due to an operation of the fur brush 48 moving toward the intermediate transferring belt 12.

The plate 68 is connected to a brush operating mechanism 70 for allowing the fur brush 48 to separate apart from or come in contact with the intermediate transferring belt 12. In particular, as shown FIGS. 5 and 6, the brush operating mechanism 70 has a shaft 74 which is provided above the sweeping roller 52. Two pressure pieces 75 are fixed to the shaft 74, and each pressure piece 75 comes in contact with an upper end side of the plate 68.

The opposite ends of the shaft 74 include one end supported freely rotatably on a side surface of the housing 42 and the other end engaged with an upper side of the plate 76. On a side of the plate 76 lower than its center of gravity, an arm 78 is supported freely rotatably, and the arm 78 extends toward a solenoid 80 fixed to the apparatus main body 2, and its leading end is connected to a plunger shaft 81. The controller 41 controls magnetizing and demagnetizing of the solenoid 80, so that moving of the arm 78, and separating and contacting of the fur brush 48 with respect to the image forming surface 30 is controlled.

In a case where the image forming surface 30 is cleaned, the solenoid 80 is magnetized in accordance with a signal transmitted from a controller 41 controller, so that the arm 78 moves toward the solenoid 80. At the same time, the plate 76 having the shaft 74 rotates in a clockwise direction from the state shown in FIG. 6 to the state shown in FIG. 7. The pressure piece 75 causes the plate 68 to rotate in a counterclockwise direction against a biasing force of the torsion spring 69. Accordingly, the fur brush 48 moves toward the intermediate transferring belt 12 to come in contact with the image forming surface 30, so that the remaining toners on the image forming surface 30 are adhered to the fur brush 48.

Figure 8:
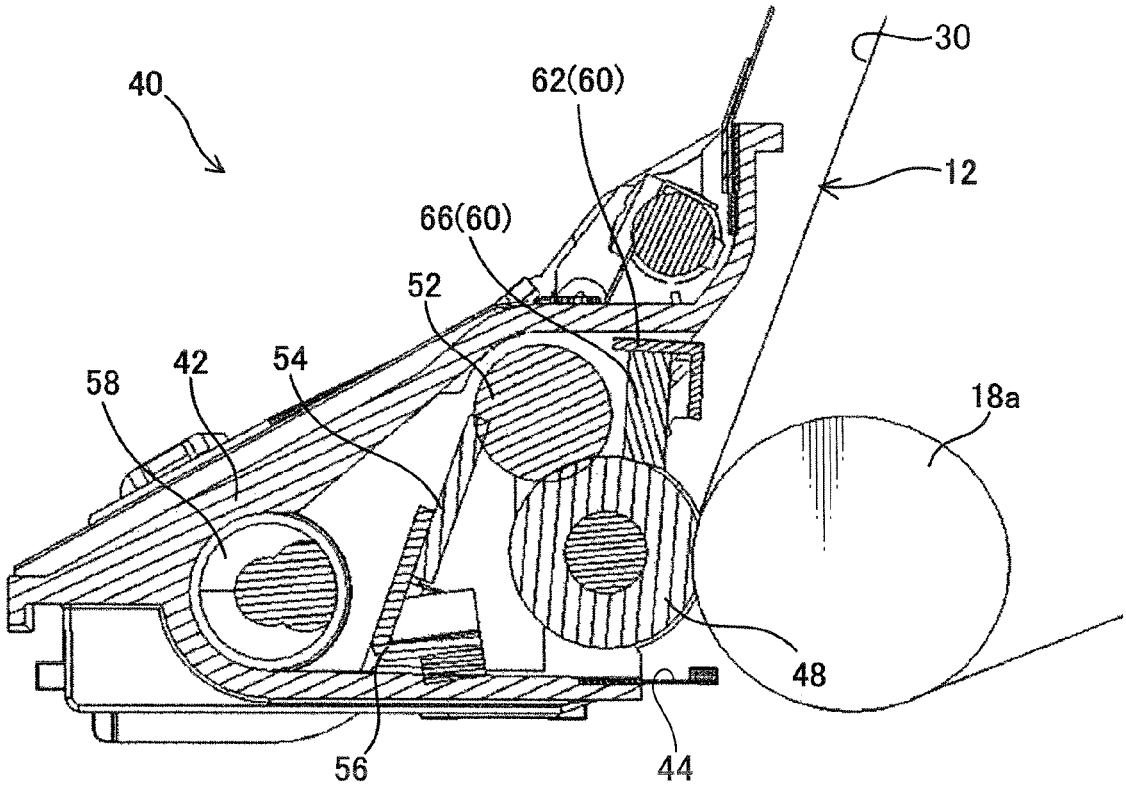
FIG. 8 is a sectional view of the cleaning unit in the state shown in FIG. 7.

This movement of the fur brush 48 causes a lower end of the solid lubricant member 66 to come in contact with the fur brush 48 not at its ridge line but at a surface. The lubricating agent scraped off by this contact is applied to the image forming surface 30 through the fur brush 48 (FIG. 8). Next, the remaining toners adhered to the fur brush 48 are taken by the sweeping roller 52, and then the remaining toners picked by the sweeping roller 52 are scraped off by the blade 54 and collected.

Figure 7:
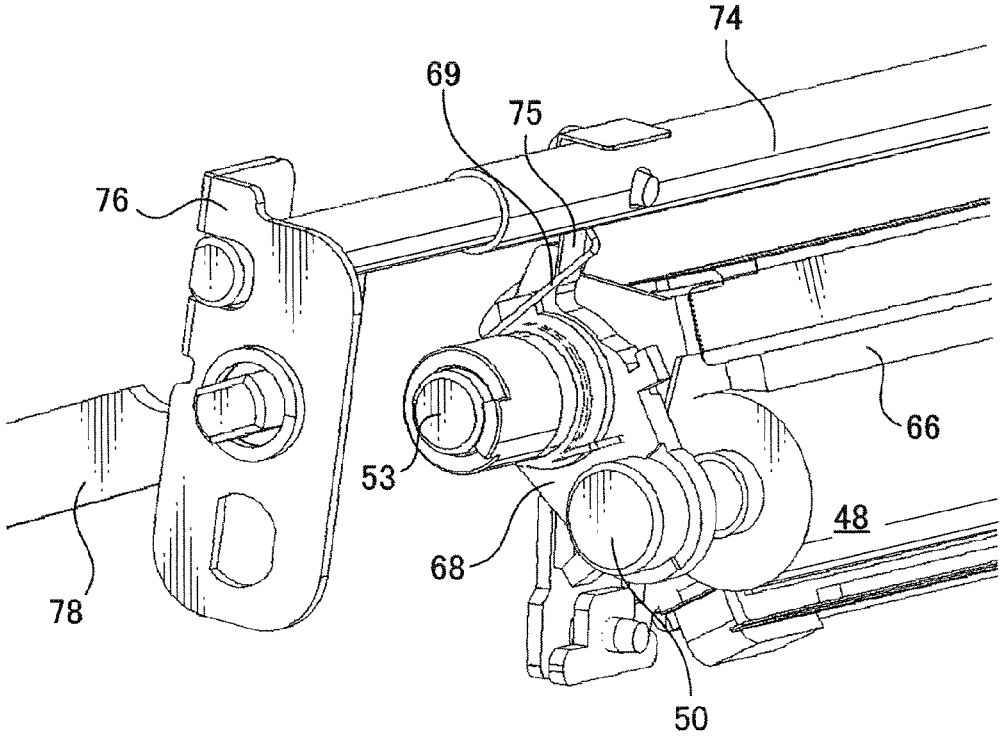
FIG. 7 shows a pressed-contact operation in the cleaning unit shown in FIG 5.

On the other hand, in a case of separating the fur brush 48 from the image forming surface 30, the solenoid 80 is magnetized in accordance with a control signal transmitted from the controller 41, so that a biasing force of the torsion spring 69 causes the plate 68 to rotate in the clockwise direction from the state shown in FIG. 7 to the state shown in FIG. 6. Accordingly, the fur brush 48 moves toward the side of the collecting spiral 58 and separates apart from the image forming surface 30. This movement of the fur brush 48 causes the lower end of the solid lubricant member 66 to separate apart from the fur brush 48 (FIG. 4).

In the present embodiment since the develop unit 10 of a rotary type is adopted, the intermediate transferring belt 12 rotates for a plurality of times in a state where a toner image is bore on the image forming surface of the intermediate transferring belt 12. As a result, the toner image bore on the image forming surface 30 passes through the position, at which the fur brush 48 faces the image forming surface 30, for a plurality of times.

In a case where the four developing equipments 10*a*, 10*b*, 10*c*, and 10*d* described above supplies toners of, for example, magenta, cyan, yellow, and black respectively to the photoconductive drum 4, a magenta toner image developed in the magenta developing equipment 10*a* is firstly transferred from the photoconductive drum 4 to the image forming surface 30 of the intermediate transferring belt 12. The intermediate transferring belt 12 rotates by one rotation in a state of bearing the magenta toner image. At this time, a portion of the image forming surface 30 bearing the magenta toner image passes through the facing position at which the fur brush 48 faces the image forming surface 30. Next, a cyan toner image developed in the cyan developing equipment 10*b* is transferred from the photoconductive drum 4 to the image forming surface 30 so as to be in superposition onto the magenta toner image. The portion of the image bearing surface 30 bearing the superimposed toner image also passes through the facing position. After on, the same applied to the cases of a yellow toner image by the yellow developing equipment 10*c* and a black toner image by the black developing equipment 10*d*, and four toner images are superimposed so that one full color toner image is formed. The full color toner image is transferred to the sheet, so that an image for one page is formed.

According to the conventional cleaning method, cleaning is performed in such a manner that the fur brush 48 comes in press-contact with the image forming surface 30 only during an interval period between transfer of a full color toner image to the sheet and bearing of a toner image for next page on the image forming surface 30. In this conventionally method, frequency in cleaning the image forming surface 30 is small, so that favorable image quality is unlikely to be maintained.

Therefore, in the present embodiment, cleaning of the image forming surface 30 is to be performed by allowing the fur brush 48 to come in press-contact with the image forming surface 30 intermittently not only during the interval period between pages but also during an image forming period of forming a full-color toner image. In other words, the controller 41 controls an operation of the solenoid 80 so that the fur brush 48 comes in press-contact with the image forming surface 30 during an interval period between passing of the toner image bore on the image forming surface 30 through the facing position and arriving of the toner image at the facing position again. This point will be described in detail with reference to FIGS. 9A-10C.

Figure 9A:
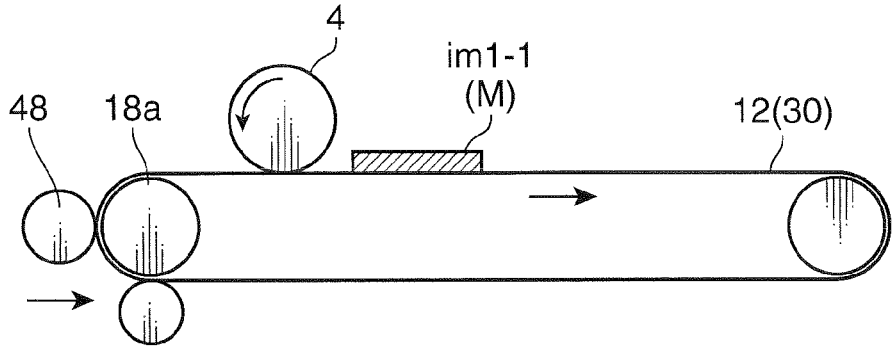
FIGS. 9A-10C schematically show the press-contact operation and the separating operation of the cleaning member with respect to an image forming surface.

In FIGS. 9A-10C, the intermediate transferring belt 12 and peripheral configuration shown in FIG. 1 are depicted in a simplified manner. FIG. 9A shows a state where formation of a first full color toner image (first color toner image) for a first page image is started on the image forming surface 30 of the intermediate transferring belt 12. In other words, FIG. 9A shows a state where a magenta toner image im1-1 (a toner image of first color) developed in the magenta developing equipment 10*a* is transferred from the photoconductive drum 4 to the image forming surface 30. The intermediate transferring belt 12 is rotationally driven for next superimposing transfer of a cyan toner image. At this time, the fur brush 48 comes in press-contact with the image forming surface 30 to clean the image forming surface 30. This contact state is continued until the portion bearing the magenta toner image im1-1 arrives at a position near the facing position at which the fur brush 48 faces the image forming surface 30.

Figure 9B:
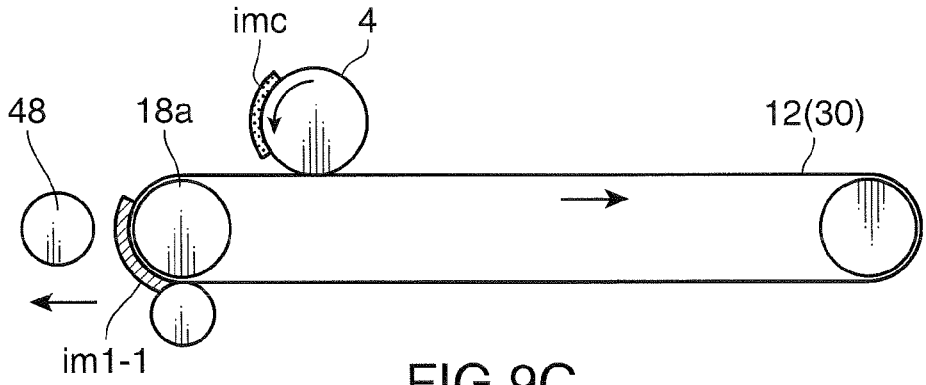

Next, as shown in FIG. 9B, when the portion bearing the magenta toner image im1-1 passes through the facing position, the controller 41 controls the solenoid 80 (operating mechanism 70) to separate the fur brush 48 from the image forming surface 30. Accordingly, the magenta toner image im1-1 is prevented from being scraped off by the fur brush 48.

Figure 9C:
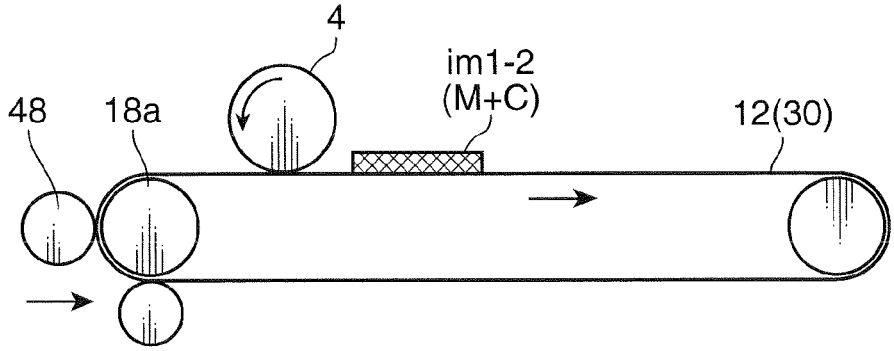

Next, when the portion bearing the magenta toner image im1-1 arrives at a position immediately under the photoconductive drum 4, as shown in FIG. 9C, a cyan toner image imc (a toner image of second color) developed by the cyan developing equipment 10*b* and formed on the photoconductive drum 4 is transferred in superimposition onto the magenta toner image im1-1, and then a first intermediate toner image im1-2 (first superimposed toner image) is bore on the image forming surface 30. At this time, the controller 41 controls the solenoid 80 to allow the fur brush 48 to come in press-contact with the image forming surface 30. This state is continued during a period (first interval period) between passing of the magenta toner image im1-1 through the facing position and arriving of the first intermediate toner image im1-2 at the position near the facing position by substantial one rotation of the intermediate transferring belt 12.

Figure 9D:
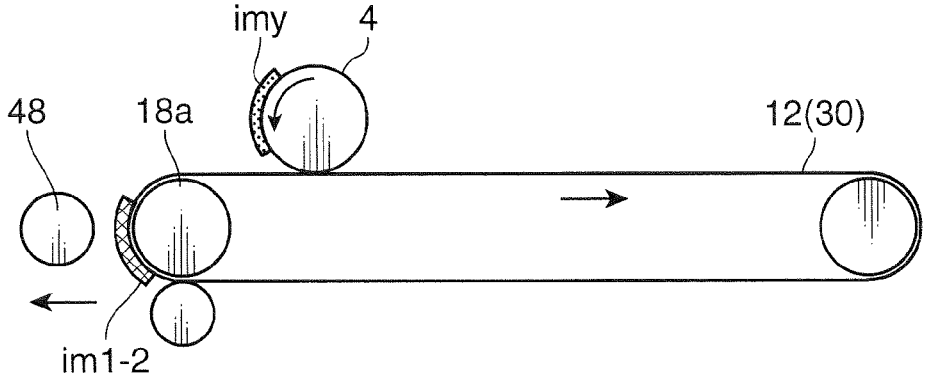

After that, as shown in FIG. 9D, when the first intermediate toner image Im1-2 passes through the facing position, the controller 41 controls the solenoid 80 to separate the fur brush 48 from the image forming surface 30. Hereinafter, though depiction is omitted, a yellow toner image imy (a toner image of third color) developed by the yellow developing equipment 10*c* and formed on the photoconductive drum 4 is transferred in superimposition onto the first intermediate toner image im1-2, and then a second intermediate toner image (second superimposed toner image) is bore on the image forming surface 30. Then, in a period (second interval period) during which the second intermediate toner image arrives at a position close to the facing position, the fur brush 48 comes in press-contact with the image forming surface 30. The same is applied to the case where the black toner image is superimposed. As described above, the controller 41 controls the solenoid 80 to repeat operations of allowing the fur brush 48 to come in press contact with and separate apart from the image forming surface 30 for a plurality of times during a page image of one sheet is created.

Figure 10A:
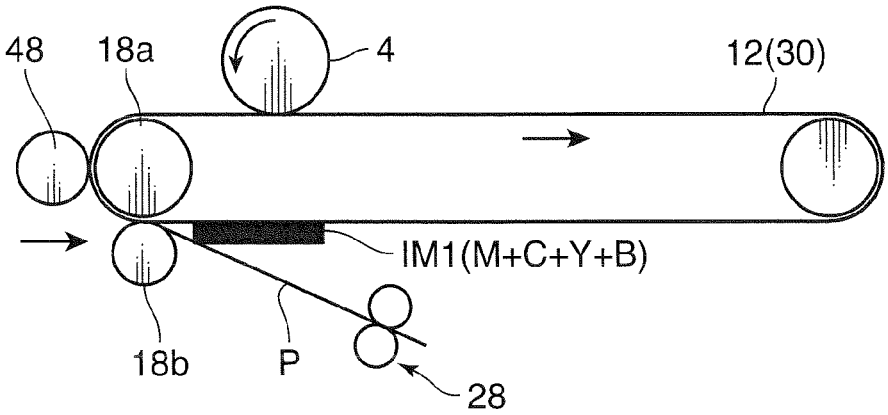

Finally, as shown in FIG. 10A, a first full color toner image IM1 is bore on the image forming surface 30. This is a toner image formed by superimposing four toner images of magenta, cyan, yellow, and black. The first full color toner image IM1 is transferred at a nip portion between the driving roller 18*a* and the transferring roller 18*b* to the sheet P conveyed by the registration roller 28 at an appropriate timing.

Figure 10B:
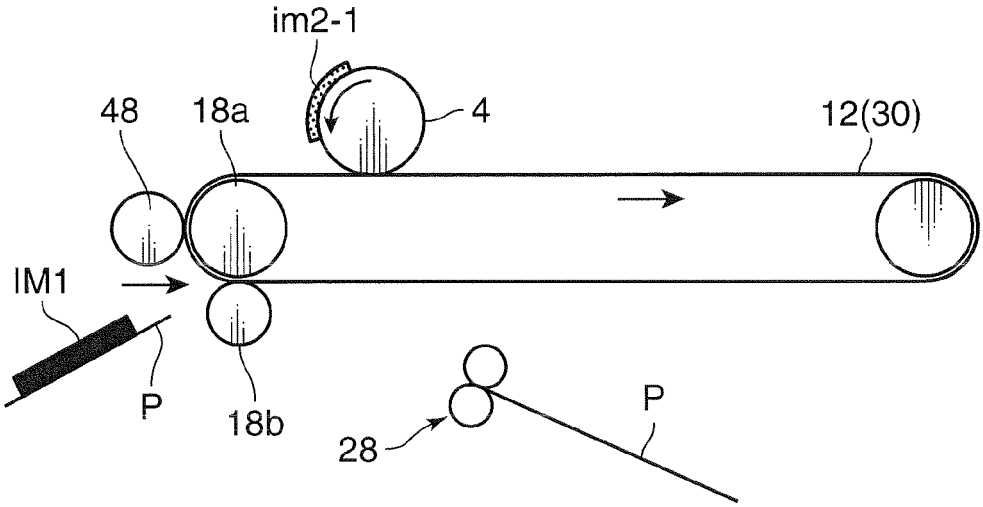
Figure 10C:
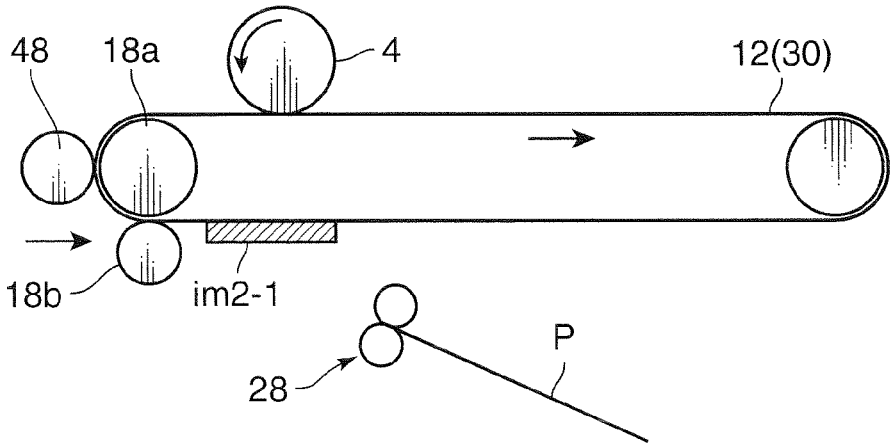

After that, as shown in FIG. 10B, formation of a second full color toner image (second color toner image) for a second page image is started, and a magenta toner image im2-1 is bore on the photoconductive drum 4. During such interval period between the pages, the fur brush 48 comes in press-contact with the image forming surface 30. As shown in FIG. 10C, this state is continued until the magenta toner image im2-1 bore on the image forming surface 30 arrives at a position close to the facing position. Subsequently, the operations similar to those described with reference to FIGS. 9B-D are repeatedly performed.

Described above is a control operation of the controller 41 in the case where continuous printing (or single page printing) of page images is performed. However, other than this, the controller 41 controls the fur brush 48 to come in press-contact with the image forming surface 30 for cleaning in accordance with an operation mode of the printer 1. In other words, the controller 41 determines if the operation mode is an image forming mode (first mode) of forming a toner image on the image forming surface 30 or a non-image forming mode (second mode) of not forming a toner image on the image forming surface 30. If it is determined that the mode is in the second mode, the controller 41 controls the solenoid 80 (operating mechanism 70) to allow the fur brush 48 to come in press-contact with the image forming surface 30.

Timings which fall in the second mode include, for example, a calibration period in the printer 1, an operation period of supplying toners to the developing unit 10, an operation period of re-freshening the intermediate transferring belt 12, and a warm-up period in the printer 1.

Figure 11:
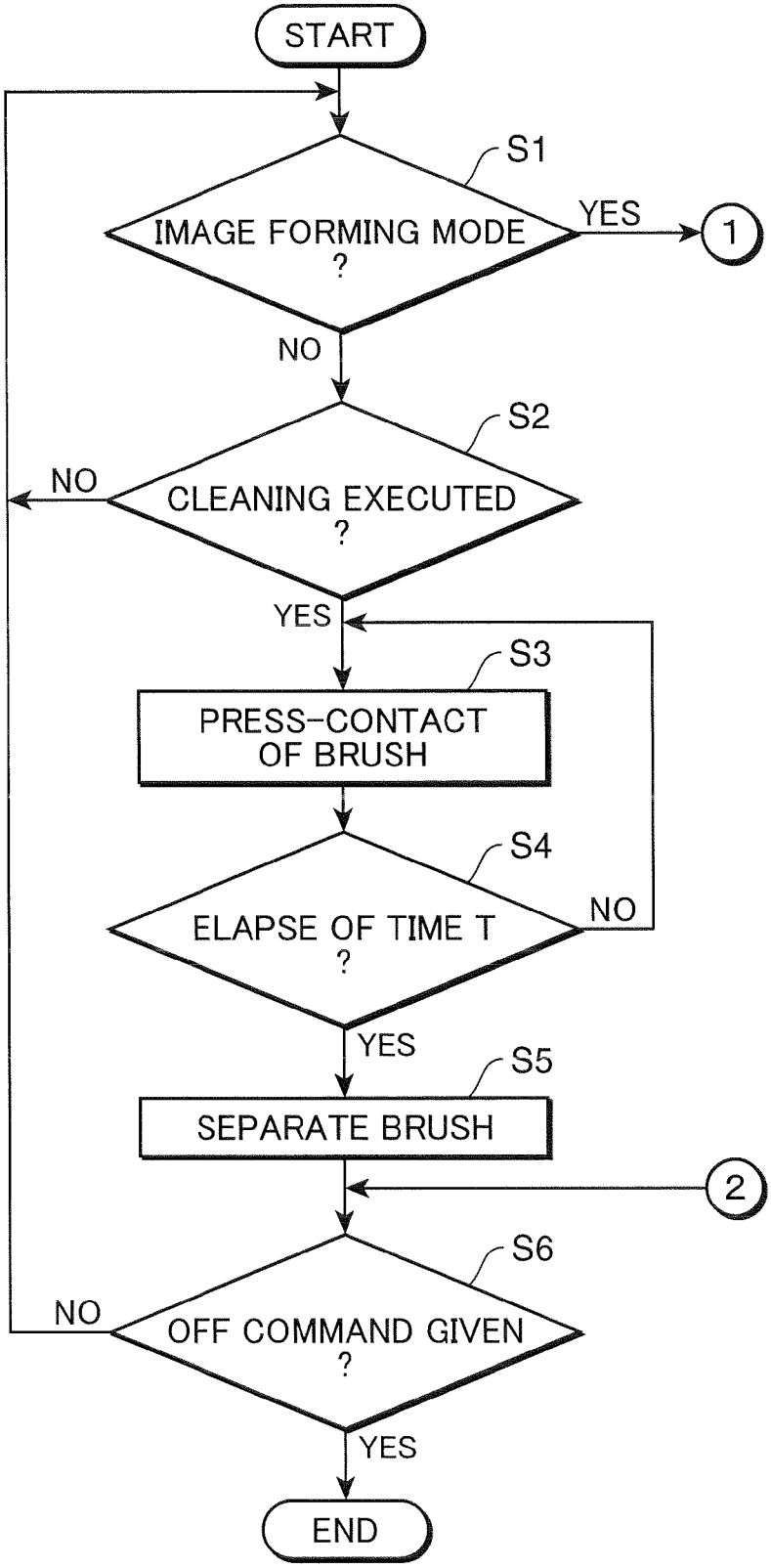
FIGS. 11 and 12 are control flowcharts of an image forming surface cleaning operation performed by the cleaning unit.
Figure 12:
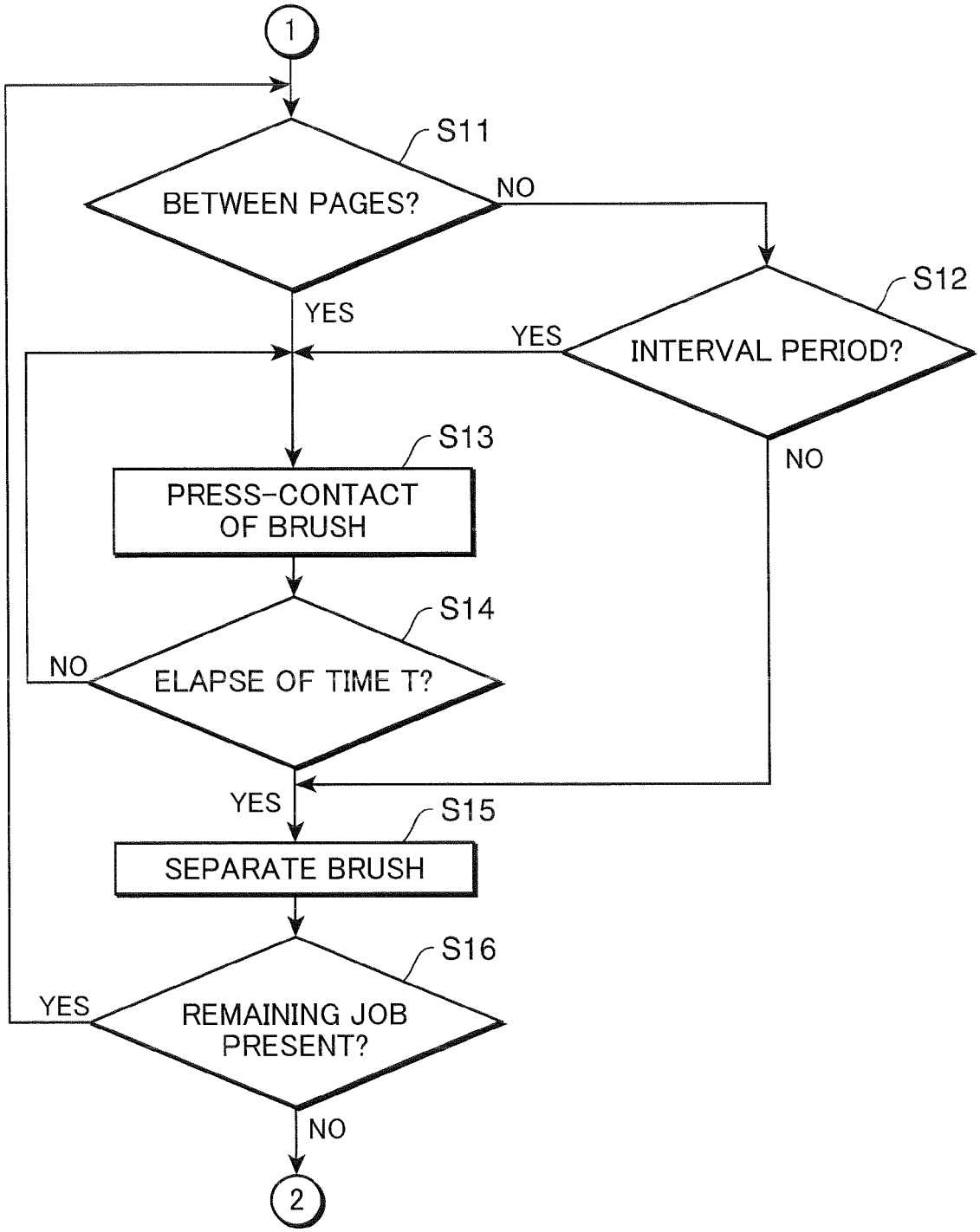

FIG. 11 and FIG. 12 are flowcharts showing the control of the cleaning operation performed by the controller 41. The controller 41 confirms whether the printer 1 is in an image forming mode (step S1). Herein, the image forming mode is a mode of executing an operation in which a toner image is formed on the peripheral surface of the photoconductive drum 4, and the toner image is transferred to the image forming surface 30 of the intermediate transferring belt 12. On the other hand, the case of not being in the image forming mode corresponds to a state where a job is not given to the printer 1 after printing of a job is completed, and a state of the "second mode".

In a case where the mode is not in the image forming mode (NO in step S1), it is confirmed whether a timing is in a predetermined cleaning execution timing (step S2). In a case where the timing is not in the cleaning execution timing (NO in step S2), the routine returns to the step SI. On the other hand, in a case where it is in the cleaning execution timing (YES in step S2), the controller 41 controls the intermediate transferring belt 12 to be rotationally driven, and controls the solenoid 80 (operating mechanism 70) to allow the fur brush 48 to come in press-contact with the image forming surface 30, so that cleaning with respect to the image forming surface 30 is started (step S3).

The controller 41 measures time from starting of the cleaning, and allows the fur brush 48 to come in press-contact with the image forming surface continuously until the time elapses a predetermined time T (step S4). At this time, a voltage is applied to the fur brush 48 and the sweeping roller 52. Then, if the cleaning period elapses the predetermined time T (YES in step S4), the controller 41 controls the solenoid 80 to separate the fur brush 48 from the image forming surface 30 (step S5). At the same time, the rotational driving of the intermediate transferring belt 12 is stopped. The predetermined time T is determined based on, for example, a rotational speed of the intermediate transferring belt 12.

Next, it is confirmed whether an OFF command is given to the printer 1 (step S6). If the OFF command is not given (NO in step S6), the routine goes back to step 1 and the processing is repeated. On the other hand, if the OFF command is given (YES in step S6), the processing is terminated.

On the other hand, if it is determined in step 1 that the operation mode is in the image forming mode (YES in step SI), the routine proceeds to the flowchart of FIG 12, and the controller 41 confirms whether or not an image forming state in the image forming section 3 is in a period between pages of one page image and next page image (step S11). If it is not in the period between pages (NO in step S11), the controller 41 further confirms whether or not it is an interval period in the step of forming one page image (step S12). As described above, the interval period indicates a period in which a toner image bore on the image forming surface 30 is not present at the facing position between the fur brush 48 and the image forming surface 30.

If it is in the period between pages (YES in step S11) and the interval period (YES in step S12), the controller 41 controls the solenoid 80 to allow the fur brush 48 to come in press-contact with the image forming surface 30, and allows the cleaning with respect to the image forming surface 30 to be started (step S13). The controller 41 measures time from starting of the cleaning, and allows the fur brush 48 to come in press-contact with the image forming surface 30 continuously until the time elapses the predetermined time T (step S14). At this time, a voltage is applied to the fur brush 48 and the sweeping roller 52.

The, if the cleaning period elapses the predetermined time T (YES in step S14), the controller 41 controls the solenoid 80 to separate the fur brush 48 from the image forming surface 30 (step S15). Even if it is not in the interval period (NO in step S12), the processing of step S15 is executed.

After that, the controller 41 confirms whether a job of the printer 1 remains (step S16). If a job remains (YES in step S16), the routine goes back to step S11 and the processing is repeated. If a job does not remain (NO in step S16), the routine proceeds to step S6.

As described above, in the present embodiment, the cleaning with respect to the image forming surface 30 by the fur brush 48 is executed not only during a period between transfer of a full color toner image for one page image and starting of forming an image of next page image, but also during one full color toner image is formed. Thus, frequency in cleaning the image forming surface 30 increases, so that favorable image quality can be maintained. Further, as a result that favorable image can be obtained, it contributes to enhance a reliability of the printer 1.

The present invention is not limited to the embodiment, and it can be modified in various ways not departing from the scope of the invention.

For example, the cleaning member is not limited to the form of the fur brush 48 of the embodiment. Further, in the embodiment, the stay 62 and the solid lubricant member 66 are capable of coming in contact with the fur brush 48 only with their weight. However, an elastic member similar to the torsion spring may be separately engaged with the stay 62, and the solid lubricant member 66 may come in contact with the fur brush 48 with a biasing force of the spring.

In the embodiment, the printer 1 having the intermediate transferring belt 12 is specifically described as an example of the image forming apparatus. A cleaning device according to the present invention may be a device which cleans an image forming surface of a printer having no intermediate transferring belt 12, in other words, an image forming surface of a photoconductive drum bearing remaining toners. Further, not limited to a printer, the present invention may be naturally applied to other image forming apparatuses such as a complex machine, a copying machine, and a facsimile machine.

The embodiment described above mainly includes the invention having the following configurations.

A cleaning device in accordance with an aspect of the present invention includes a cleaning device for cleaning an image forming surface of a rotating image bearing member which bears a toner image, and the cleaning device includes: a cleaning member which faces the image forming surface at a predetermined position to clean the image forming surface; an operating mechanism for allowing the cleaning member to come in press-contact with and separate apart from the image forming surface; and a controller for controlling the operating mechanism. The image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

According to this configuration, the controller allows the cleaning member to clean the image forming surface during the interval period. Accordingly, frequency in cleaning the image forming surface can be increased, so that favorable image quality can be maintained.

In the configuration above, it is preferable that the image bearing member rotates so that the toner image bore on the image forming surface passes through the facing position for a plurality of times, and the controller controls the operating mechanism to repeatedly perform operations of allowing the cleaning member to come in press-contact with the image forming surface during the interval period and allowing the cleaning member to separate apart from the image forming surface when the toner image passes through the facing position. According to this configuration, the image forming surface is cleaned at higher frequency, so that more favorable image quality can be maintained.

In the configuration above, it is preferable that the cleaning member includes a roller-like brush member having a shaft extending in a width direction perpendicular to a rotational direction of the image bearing member, and rotating about the shaft. Such brush member is suitable for repeatedly perform a press-contact and separation with respect to the image forming surface.

In this case, it is preferable that there is further provided a solid lubricant member which is capable of coming in contact with the roller-like brush member to provide lubricity to the image forming surface through the roller-like brush member. Further, it is preferable that the solid lubricant member comes in contact with the roller-like brush member in a state where the roller-like brush member is in press-contact with the image forming surface, and the solid lubricant member separates apart from the roller-like brush member in a state where the roller-like brush member separates apart from the image forming surface. According to this configuration, lubricity is given to the image forming surface through the roller-like brush member. Accordingly, friction on the image forming surface is reduced.

In the configuration above, it is preferable that the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

According to this configuration, the image forming surface is cleaned even in the second mode in which a cleaning operation is not usually performed. Accordingly, the image forming surface can be further cleaned.

A cleaning device in accordance with another aspect of the present invention includes: a cleaning member which faces the image forming surface at a predetermined position to clean the image forming surface; an operating mechanism for allowing the cleaning member to come in press-contact with and separate apart from the image forming surface; and a controller for controlling the operating mechanism. The controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

According to this configuration, the image forming surface is cleaned even in the second mode in which a cleaning operation is not usually performed. Thus, the image forming surface can be further cleaned, and favorable image quality can be maintained.

In this case, it is preferable that the image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

According to this configuration, the controller may allow the cleaning member to clean the image forming surface during a period in which the toner image is not present at the facing position. Accordingly, frequency in cleaning the image forming surface can be made higher.

An image forming apparatus in accordance with yet another aspect of the present invention includes: a rotating image bearing member including an image forming surface on which a toner image is formed; and a cleaning device for cleaning the image forming surface. The cleaning device includes: a cleaning member which faces the image forming surface at a predetermined position to clean the image forming surface; an operating mechanism for allowing the cleaning member to come in press-contact with and separate apart from the image forming surface; and a controller for controlling the operating mechanism. The image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

According to this configuration, the controller may allow the cleaning member to clean the image forming surface during the interval period. Accordingly, frequency in cleaning the image forming surface can be made higher, and favorable image quality can be maintained. Thus, it contributes to enhance a reliability of the image forming apparatus.

In the image forming apparatus above, it is preferable that there are further provided: a photoconductive drum having a peripheral surface on which a toner image is formed; and a developing unit of a rotary type for supplying toners to the photoconductive drum, and the image bearing member includes an intermediate transferring belt to which the toner image is primarily transferred from the photoconductive drum, and from which the toner image is secondarily transferred to a sheet-like recording medium.

In the developing unit of a rotary type, the toner image bore on the intermediate transferring belt passes through the position, at which the cleaning member faces the image forming surface, for a plurality of times, it is favorable to adopt the present invention.

In the configuration above, it is preferable that the developing unit includes developing rollers for bearing toners of different colors, and the developing rollers supply toners of respective colors to the photoconductive drum, and the image forming surface bears a first color toner image, and bears a second color toner image after the first color toner image is transferred to the sheet-like recording medium, and the first color toner image includes at least a toner image having a first color and transferred to the image forming surface of the intermediate transferring belt through the photoconductive drum, and a toner image having a second color, which is different from the first color, and superimposed onto the primarily transferred toner image of the first color after one rotation of the intermediate transferring belt, and the controller controls the operating mechanism so that the cleaning member comes in press-contact with the image forming surface during a first interval period between passing of the toner image having the first color through the facing position and arriving of a first superimposed toner image, which includes the toner image having the first color and the toner image having the second color, at the facing position again.

According to this configuration, the image forming surface is cleaned not only after the first color toner image is transferred and before the second color toner image is started to be bore, but also during the first interval period in creating of the first color toner image. Thus, frequency in cleaning the image forming surface can be made higher.

In this case, it is more preferable that a third toner image having a third color, which is different from the first color and the second color, is further transferred in superimposition onto the first superimposed toner image, so that a second superimposed toner image is formed on the image forming surface, and the controller controls the operating mechanism so that: the cleaning member comes in press-contact with the image forming surface during the first interval period; the cleaning member separates apart from the image forming surface when the first superimposed toner image passes through the facing position; and the cleaning member comes in press-contact with the image forming apparatus during a second interval period between passing of the first superimposed toner image through the facing position and arriving of the second superimposed toner image at the facing position again.

According to this configuration, in creating the first color toner image, the image forming surface is cleaned for at least two times, i.e. in the first interval period and the second interval period. Thus, the image forming surface is cleaned at higher frequency, so that more favorable image quality can be maintained.

In the configuration above, it is preferable that the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

An image forming apparatus in accordance with yet another aspect of the present invention includes: a rotating image bearing member including an image forming surface on which a toner image is formed; and a cleaning device for cleaning the image forming surface. The cleaning device includes: a cleaning member which faces the image forming surface at a predetermined position to clean the image forming surface; an operating mechanism for allowing the cleaning member to come in press-contact with and separate apart from the image forming surface; and a controller for controlling the operating mechanism. The controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

According to this configuration, the image forming surface is cleaned even in the second mode in which the cleaning operation is not usually performed. Thus, the image forming surface can be further cleaned, and favorable image quality can be maintained.

In this case, it is preferable that the controller controls the operating mechanism so that the cleaning member comes in contact with the image forming surface at a timing of a calibration period in the image forming apparatus, an operation period for supplying toners to the developing unit, an operation period for re-freshening the image bearing member, or a warm-up period in the image forming apparatus.

This application is based on Japanese Patent application serial No. 2007-217899 filed in Japan Patent Office on Aug. 24, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A cleaning device for cleaning an image forming surface of a rotating image bearing member which bears a toner image, the cleaning device comprising:

a cleaning member which faces the image forming surface at a predetermined position to clean the image forming surface;

an operating mechanism for allowing the cleaning member to come in press-contact with and separate apart from the image forming surface; and a controller for controlling the operating mechanism, wherein the image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

2. The cleaning device according to claim 1, wherein the image bearing member rotates so that the toner image bore on the image forming surface passes through the facing position for a plurality of times, and the controller controls the operating mechanism to repeatedly perform operations of allowing the cleaning member to come in press-contact with the image forming surface during the interval period and allowing the cleaning member to separate apart from the image forming surface when the toner image passes through the facing position.

3. The cleaning device according to claim 1, wherein the cleaning member includes a roller-like brush member having a shaft extending in a width direction perpendicular to a rotational direction of the image bearing member, and rotating about the shaft.

4. The cleaning device according to claim 3, further comprising:

a solid lubricant member which is capable of coming in contact with the roller-like brush member to provide lubricity to the image forming surface through the roller-like brush member.

5. The cleaning device according to claim 4, wherein the solid lubricant member comes in contact with the roller-like brush member in a state where the roller-like brush member is in press-contact with the image forming surface, and the solid lubricant member separates apart from the roller-like brush member in a state where the roller-like brush member separates apart from the image forming surface.

6. The cleaning device according to claim 1, wherein the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

7. A cleaning device for cleaning an image forming surface of a rotating image bearing member which bears a toner image, the cleaning device comprising:

a cleaning member which faces the image forming surface at a predetermined position to clean the image forming surface;

an operating mechanism for allowing the cleaning member to come in press-contact with and separate apart from the image forming surface; and a controller for controlling the operating mechanism, wherein the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface, wherein the image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

8. An image forming apparatus, comprising:

a rotating image bearing member including an image forming surface on which a toner image is formed; and a cleaning device for cleaning the image forming surface, wherein the cleaning device includes:

a cleaning member which faces the image forming surface at a predetermined position to clean the image forming surface;

an operating mechanism for allowing the cleaning member to come in press-contact with and separate apart from the image forming surface; and a controller for controlling the operating mechanism, wherein the image bearing member rotates so that in a state where a toner image is bore on the image forming surface, the toner image passes through a facing position at which the cleaning member faces the image forming surface, and the controller controls the operating mechanism so that the cleaning member comes in press-contact with the image forming surface during an interval period which is a period between passing of the toner image through the facing position and arriving of the toner image at the facing position again.

9. The image forming apparatus according to claim 8, further comprising:

a photoconductive drum having a peripheral surface on which a toner image is formed; and a developing unit of a rotary type for supplying toners to the photoconductive drum, wherein the image bearing member includes an intermediate transferring belt to which the toner image is primarily transferred from the photoconductive drum, and from which the toner image is secondarily transferred to a sheet-like recording medium.

10. The image forming apparatus according to claim 9, wherein the developing unit includes developing rollers for bearing toners of different colors, and the developing rollers supply toners of respective colors to the photoconductive drum, and the image forming surface bears a first color toner image, and bears a second color toner image after the first color toner image is transferred to the sheet-like recording medium, and the first color toner image includes at least a toner image having a first color and transferred to the image forming surface of the intermediate transferring belt through the photoconductive drum, and a toner image having a second color, which is different from the first color, and superimposed onto the primarily transferred toner image of the first color after one rotation of the intermediate transferring belt, and the controller controls the operating mechanism so that the cleaning member comes in press-contact with the image forming surface during a first interval period between passing of the toner image having the first color through the facing position and arriving of a first superimposed toner image, which includes the toner image having the first color and the toner image having the second color, at the facing position again.

11. The image forming apparatus according to claim 10, wherein a third toner image having a third color, which is different from the first color and the second color, is further transferred in superimposition onto the first superimposed toner image, so that a second superimposed toner image is formed on the image forming surface, and the controller controls the operating mechanism so that:

the cleaning member comes in press-contact with the image forming surface during the first interval period;

the cleaning member separates apart from the image forming surface when the first superimposed toner image passes through the facing position; and the cleaning member comes in press-contact with the image forming apparatus during a second interval period between passing of the first superimposed toner image through the facing position and arriving of the second superimposed toner image at the facing position again.

12. The image forming apparatus according to claim 8, wherein the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface.

13. An image forming apparatus, comprising:

a photoconductive drum having a peripheral surface on which a toner image is formed;

a developing unit of a rotary type for supplying toners to the photoconductive drum, the developing unit includes developing rollers for bearing toners of different colors, and the developing rollers supply toners of respective colors to the photoconductive drum;

a rotating image bearing member including an image forming surface on which a toner image is formed, the image bearing member includes an intermediate transferring belt to which the toner image is primarily transferred from the photoconductive drum, and from which the toner image is secondarily transferred to a sheet-like recording medium, the image forming surface bears a first color toner image and bears a second color toner image after the first color toner image is transferred to the sheet-like recording medium;

the first color toner image includes at least a toner image having a first color and transferred to the image forming surface of the intermediate transferring belt through the photoconductive drum, and the second color toner image having a second color, which is different from the first color, and superimposed onto the primarily transferred toner image of the first color after one rotation of the intermediate transferring belt; and a cleaning device for cleaning the image forming surface, wherein the cleaning device includes:

a cleaning member which faces the image forming surface at a predetermined facing position to clean the image forming surface;

an operating mechanism for allowing the cleaning member to come in press-contact with and separate apart from the image forming surface; and a controller for controlling the operating mechanism, and the controller determines if an operation mode is in a first mode of forming a toner image on the image forming surface or a second mode of not forming a toner image on the image forming surface, and when it is determined that the operation mode is in the second mode, the controller controls the operating mechanism so that the cleaning member comes in press-contact with the image forming surface, wherein the controller controls the operating mechanism so that the cleaning member comes in press-contact with the image forming surface during a first interval period between passing of the toner image having the first color through the facing position and arriving of a first superimposed toner image, which includes the toner image having the first color and the toner image having the second color, at the facing position again.

14. The image forming apparatus according to claim 13, wherein a third toner image having a third color, which is different from the first color and the second color, is further transferred in superimposition onto the first superimposed toner image, so that a second superimposed toner image is formed on the image forming surface, and the controller controls the operating mechanism so that:

the cleaning member comes in press-contact with the image forming surface during the first interval period;

the cleaning member separates apart from the image forming surface when the first superimposed toner image passes through the facing position; and the cleaning member comes in press-contact with the image forming apparatus during a second interval period between passing of the first superimposed toner image through the facing position and arriving of the second superimposed toner image at the facing position again.

15. The image forming apparatus according to claim 13, wherein the controller controls the operating mechanism so that the cleaning member comes in contact with the image forming surface at a timing of a calibration period in the image forming apparatus, an operation period for supplying toners to the developing unit, an operation period for re-freshening the image bearing member, or a warm-up period in the image forming apparatus.

* * * * *